US008418976B1

(12) United States Patent
Shahkaram

(10) Patent No.: US 8,418,976 B1
(45) Date of Patent: Apr. 16, 2013

(54) SHEET MOUNTING APPARATUS

(76) Inventor: Nazar Said Shahkaram, London (CA)

( * ) Notice: Subject to any disclaimer, the term of this patent is extended or adjusted under 35 U.S.C. 154(b) by 218 days.

(21) Appl. No.: 12/805,024

(22) Filed: Jul. 7, 2010

(51) Int. Cl.
*A47G 1/10* (2006.01)

(52) U.S. Cl.
USPC ..... 248/316.8; 248/441.1; 248/447.1; 248/316.1; 40/647

(58) Field of Classification Search ..... 248/274.1, 248/441.1, 447.1, 448, 489, 490, 466, 467, 248/316.1, 316.4, 316.8; 40/647; 281/42, 281/45; 223/85, 93, 96
See application file for complete search history.

(56) References Cited

U.S. PATENT DOCUMENTS

| | | | | | |
|---|---|---|---|---|---|
| 524,451 | A * | 8/1894 | Ward | 248/451 |
| 2,463,451 | A * | 3/1949 | Yates | 248/316.2 |
| 2,875,970 | A * | 3/1959 | Gardner | 248/101 |
| 3,350,045 | A * | 10/1967 | Mayers | 248/205.3 |
| 3,737,178 | A * | 6/1973 | Tjernlund et al. | 281/42 |
| 3,999,252 | A * | 12/1976 | Bianco | 248/489 |
| 4,549,713 | A * | 10/1985 | Magadini | 248/495 |
| 4,726,606 | A * | 2/1988 | D'Alessandro | 281/42 |
| 4,953,714 | A * | 9/1990 | Paul | 211/36 |
| 5,102,087 | A * | 4/1992 | Brunell | 248/451 |
| 5,342,014 | A * | 8/1994 | Wilson | 248/476 |
| 5,722,691 | A * | 3/1998 | Patel | 281/42 |
| 7,996,963 | B2 * | 8/2011 | Cameron | 24/344 |
| 2004/0026593 | A1 * | 2/2004 | Fay | 248/489 |
| 2005/0205742 | A1 * | 9/2005 | Kixmoeller | 248/323 |
| 2006/0226315 | A1 * | 10/2006 | Beasley et al. | 248/229.13 |

* cited by examiner

*Primary Examiner* — Anita M King
(74) *Attorney, Agent, or Firm* — Brunet & Co. Ltd.; Robert A. H. Brunet

(57) ABSTRACT

One or more mounting members are slidably mounted along the strap by threading the strap through a plurality of slits, typically a pair, in each mounting member. The mounting members can be flexible or inflexible, and formed from a variety of materials, such as metals, plastics or a composite material. Each mounting member can additionally include one or more wings, typically a pair, which allows the user to easily slide the mounting member along the strap. A user can grasp a wing to lift an edge of the mounting member away from the strap and then insert one or more sheets between the mounting member and the strap. Once the user releases the wing, the mounting member is urged toward the strap, creating sufficient pressure to hold the inserted sheet in place.

17 Claims, 8 Drawing Sheets

SHEET MOUNTING APPARATUS

FIELD

The present application relates generally to a sheet mounting apparatus. More particularly, the present application relates to a sheet mounting apparatus comprising mounting members movable along a strap.

BACKGROUND

A variety of devices for mounting sheets, such as papers, photos and notes, are known in the art. However, there is an ever-present need for an apparatus for mounting sheets with improved efficacy, ease of use, scalability, safety and cost.

BRIEF DESCRIPTION OF THE DRAWINGS

Embodiments will now be described, by way of example only, with reference to the attached Figures, wherein.

DESCRIPTION

Figure 1:
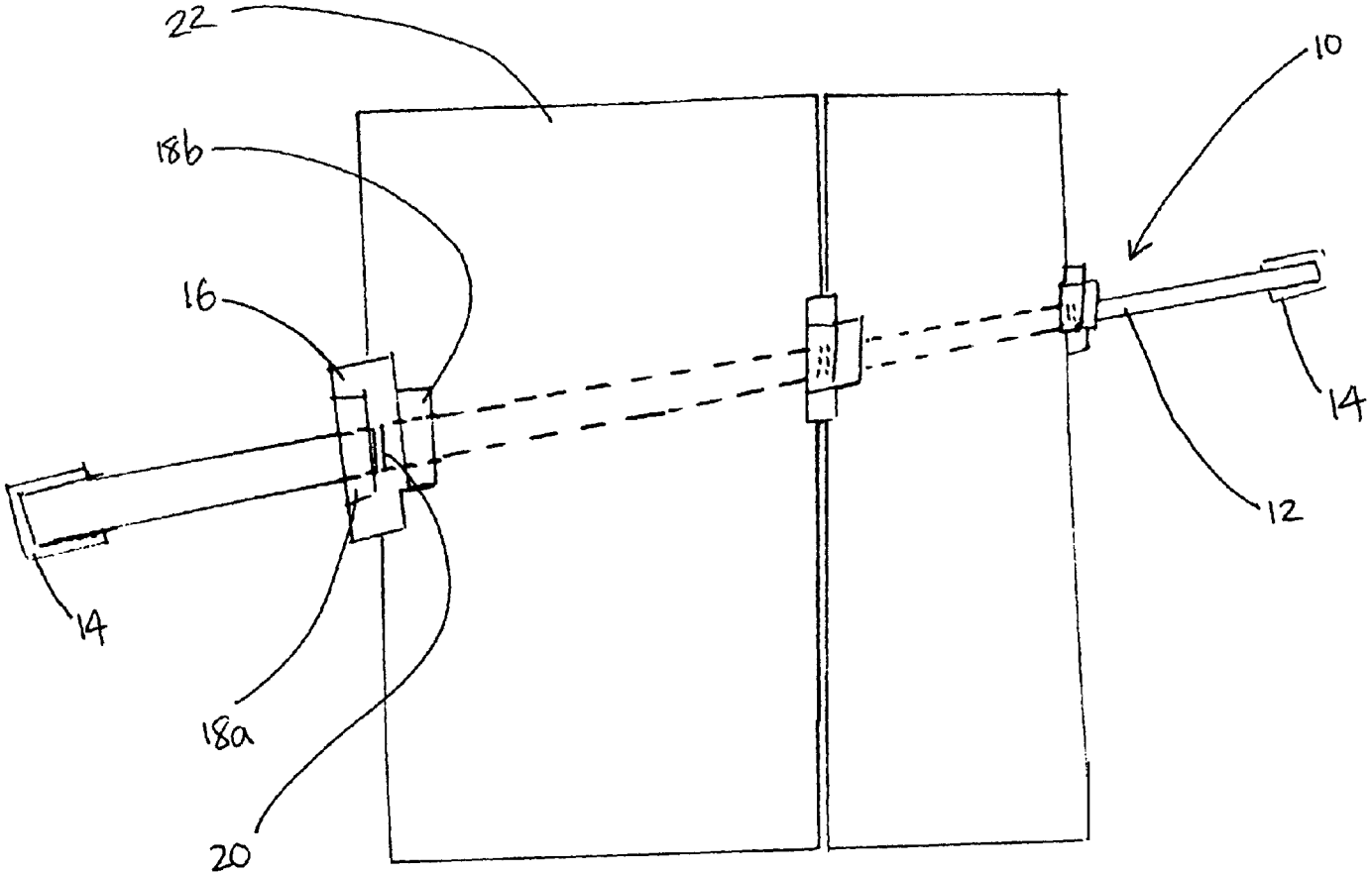
FIG. 1 is a front perspective view of an embodiment of the sheet mounting apparatus with one or more mounted sheets.

Generally, there is provided an apparatus for mounting sheets to a surface. FIG. 1 shows a front perspective view of an embodiment of the sheet mounting apparatus 10. The sheet mounting apparatus 10 comprises one or more tracks or straps 12, a plurality of fasteners 14 for securing the one or more straps 12 to a surface, and one or more clips or mounting members 16 slidably mounted along the one or more straps 12. As shown in FIG. 1, a strap 12 is mounted in any orientation along a surface, such as a wall or a pole, by a pair of fasteners 14 located at each end of the strap 12. Strap 12 can be transparent or opaque, and manufactured in a variety of lengths from a variety of materials, such as metals, plastics, fabrics, or a combination of materials. Fasteners 14 may include a variety of means, such as adhesive, removable adhesives, staples, suction cups, fabric hook and loop fasteners, buttons, clips, and other fasteners known in the art. Additional fasteners 14 can be used to provide additional support for the strap 12, particularly if strap 12 is very long.

One or more mounting members 16 are slidably mounted along strap 12 by threading strap 12 through a plurality of slits 20, typically a pair, in each mounting member 16. The mounting members 16 can be flexible or inflexible, and formed from a variety of materials such as metals, plastics, or a composite of materials. Each mounting member 16 can additionally include one or more wings 18*a* and 18*b*, typically a pair, which allow the user to easily slide the mounting member 16 along the strap 12. A user can grasp a wing 18*b* to lift an edge of the mounting member 16 away from strap 12, and then insert one or more sheets 22 between the mounting member 16 and strap 12. Once the user releases wing 18*b*, mounting member 16 is urged toward strap 12, creating sufficient pressure to hold the inserted sheet 22 in place. The insertion of one or more sheets 22 under wing 18*b* increases the pressure exerted under wing 18*a* by the mounting member 16 on the strap 12, and accordingly, the pressure exerted on a sheet subsequently inserted there between.

Figure 2:
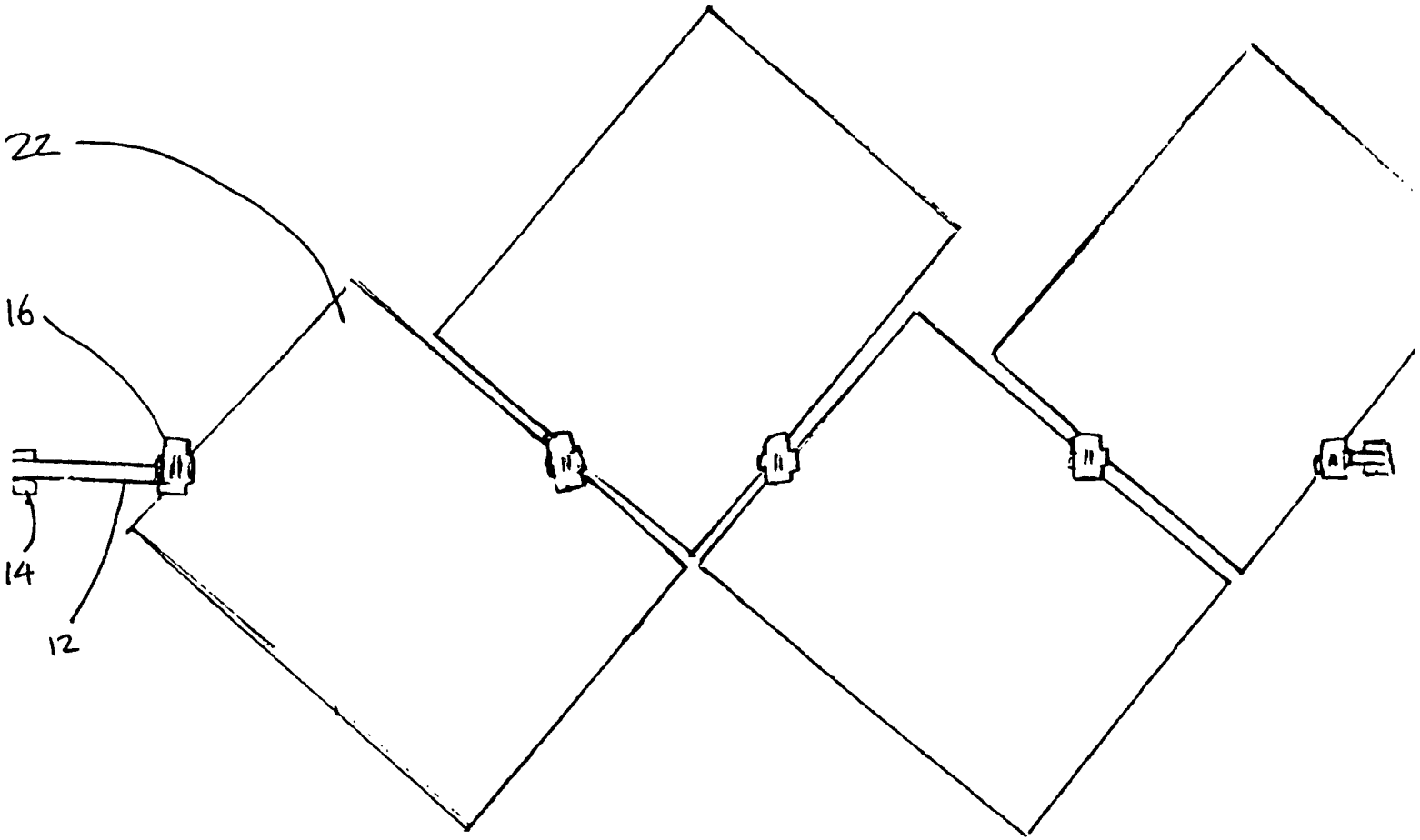
FIG. 2 is a front elevation view of an embodiment of the sheet mounting apparatus with an alternative mounting arrangement of sheets.

In FIG. 1, one or more sheets 22 are held in place by a pair of mounting members 16 securing opposing edges of the one or more sheets 22. However, a variety of mounting arrangements of sheets is possible. For example, FIG. 2 shows a front elevation view of an embodiment of the sheet mounting apparatus 10 in which one or more sheets 22 are held by a pair mounting members 16 securing adjacent edges of sheet 22, making for an arrangements of sheets 22 diagonally oriented with respect to the strap 12. It will be understood that by varying the orientation of the sheet mounting apparatus 10 along the surface, and the orientation of the sheets 22 with respect to the sheeting mounting apparatus 10, the sheets 22 can be mounted in many different orientations.

Figure 3:
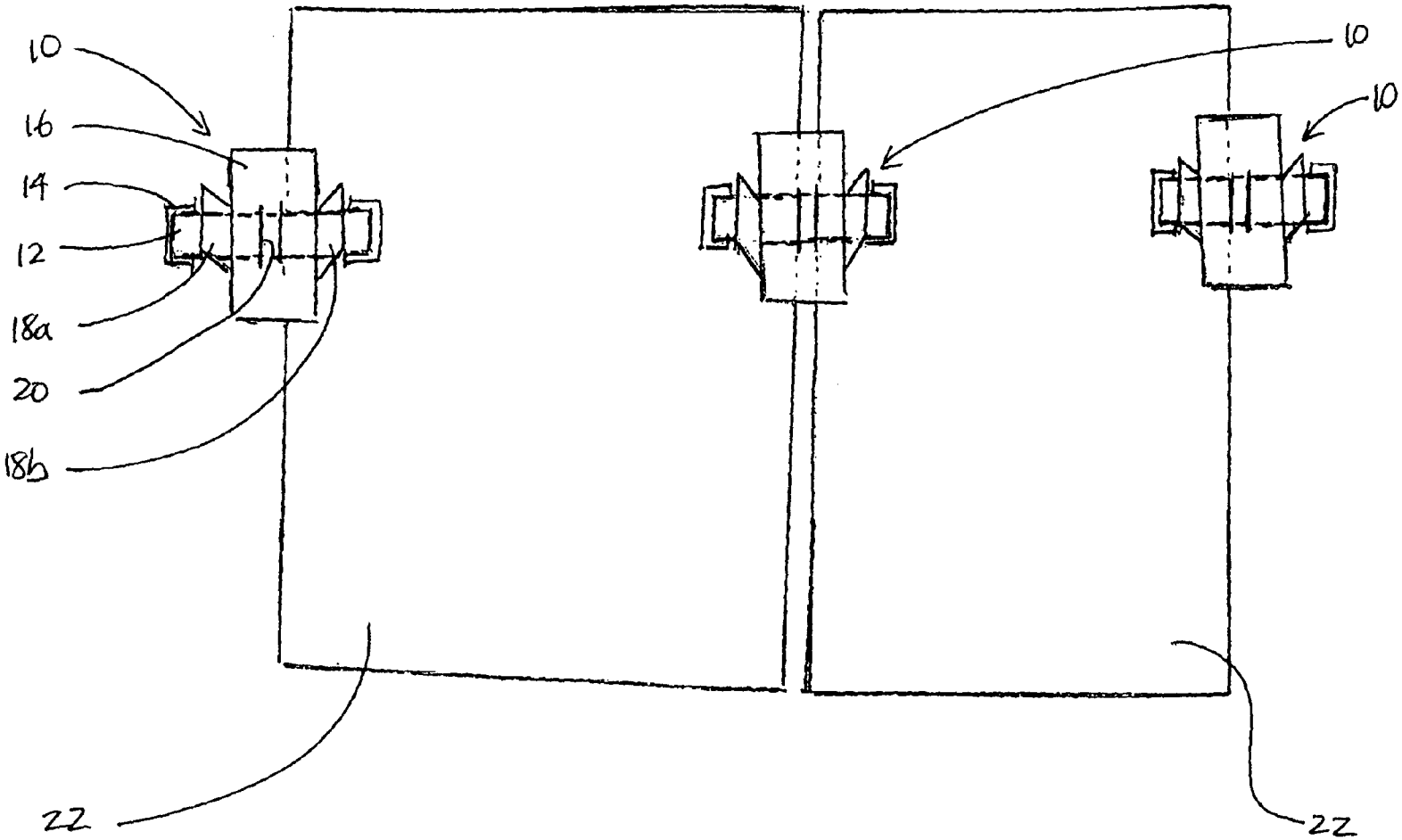
FIG. 3 is a front perspective view of a plurality of sheet mounting apparatuses, according to an embodiment, cooperating to mount sheets.

As illustrated in FIG. 3, a plurality of sheet mounting apparatuses 10 can cooperate to mount sheets 22. In this arrangement, each sheet mounting apparatus 10 includes a single mounting member 16 which mounts an edge of sheet 22. This arrangement provides additional flexibility in spacing sheets in the mounting arrangement, and allows large sheets 22 to be mounted while using relatively short straps 12, since each strap 12 needs only enough length to accommodate a single mounting member 16. In some cases, the strap 12 may be long enough to allow some adjustment of the position of the mounting member 16. It will be understood that in similar arrangements, a plurality of sheet mounting apparatuses 10, each comprising one or more mounting members 16, can cooperate to mount sheets 22. In an alternative embodiment, the sheet mounting apparatus 10 comprises a mounting member 16 and a fastener 14. The mounting member 16 attaches to the surface via fastener 14, and sheets are held by the pressure exerted between the mounting member 16 and the surface.

Figure 4:
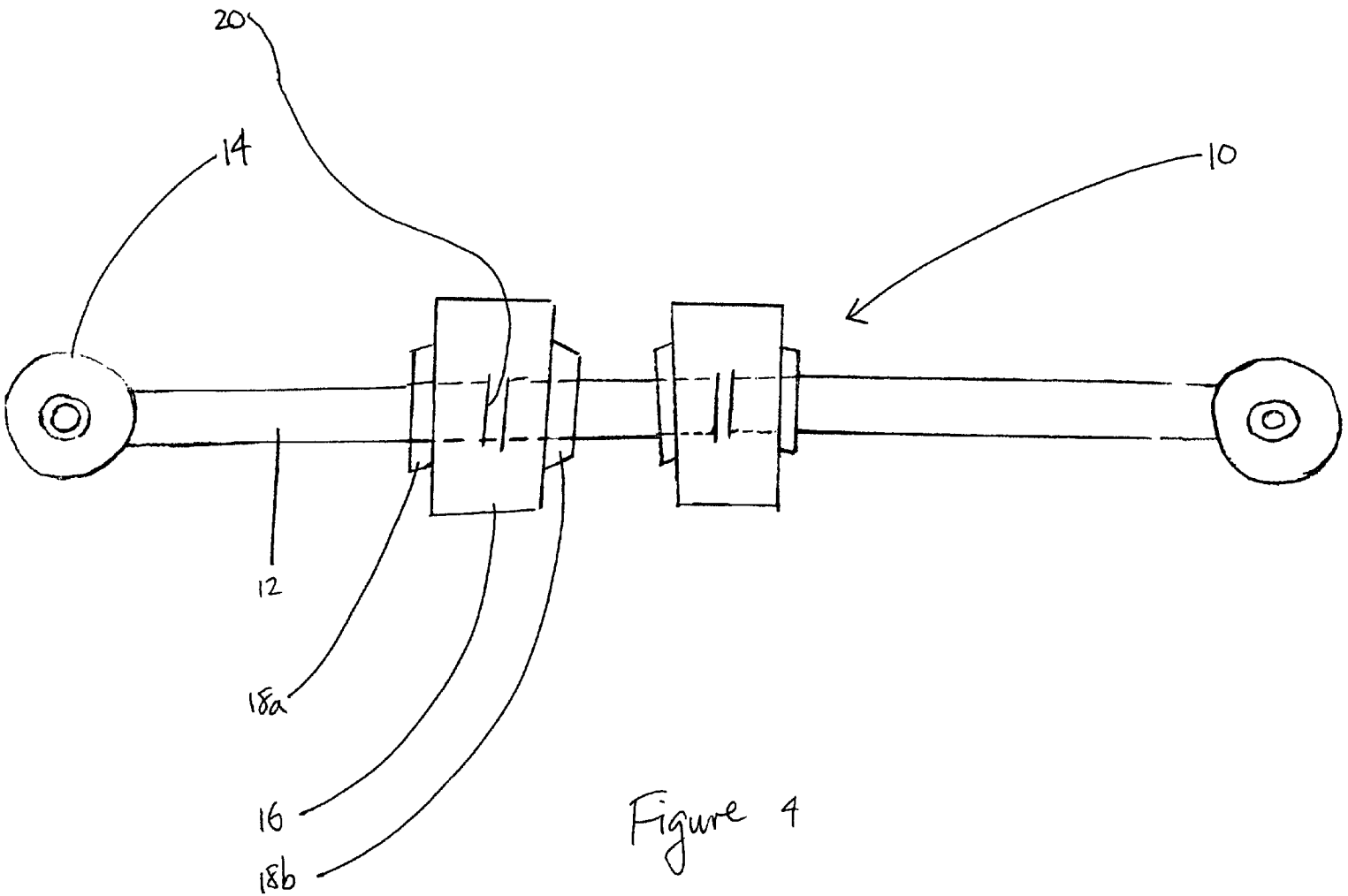
FIG. 4 is a front perspective view of an alternative embodiment of the sheet mounting apparatus.

FIG. 4 shows a front perspective view of an alternative embodiment the sheet mounting apparatus 10 adapted for use on glass. Fastener 14 is a suction cup, through other fasteners suitable to attach strap 12 to glass can be used, such as a removable adhesive. Strap 12 is preferably transparent so that the strap 12 will not block any part of a mounted sheet from view. Mounting members 16 may also be transparent. Accordingly, a sheet with content on both sides can be mounted on a display window and viewed from both sides of the window. Alternatively, a pair of sheets each with content on a single side can be mounted on a window for viewing from both sides of the window by mounting the first sheet facing the window, and the second sheet facing away from the window.

Figure 5:
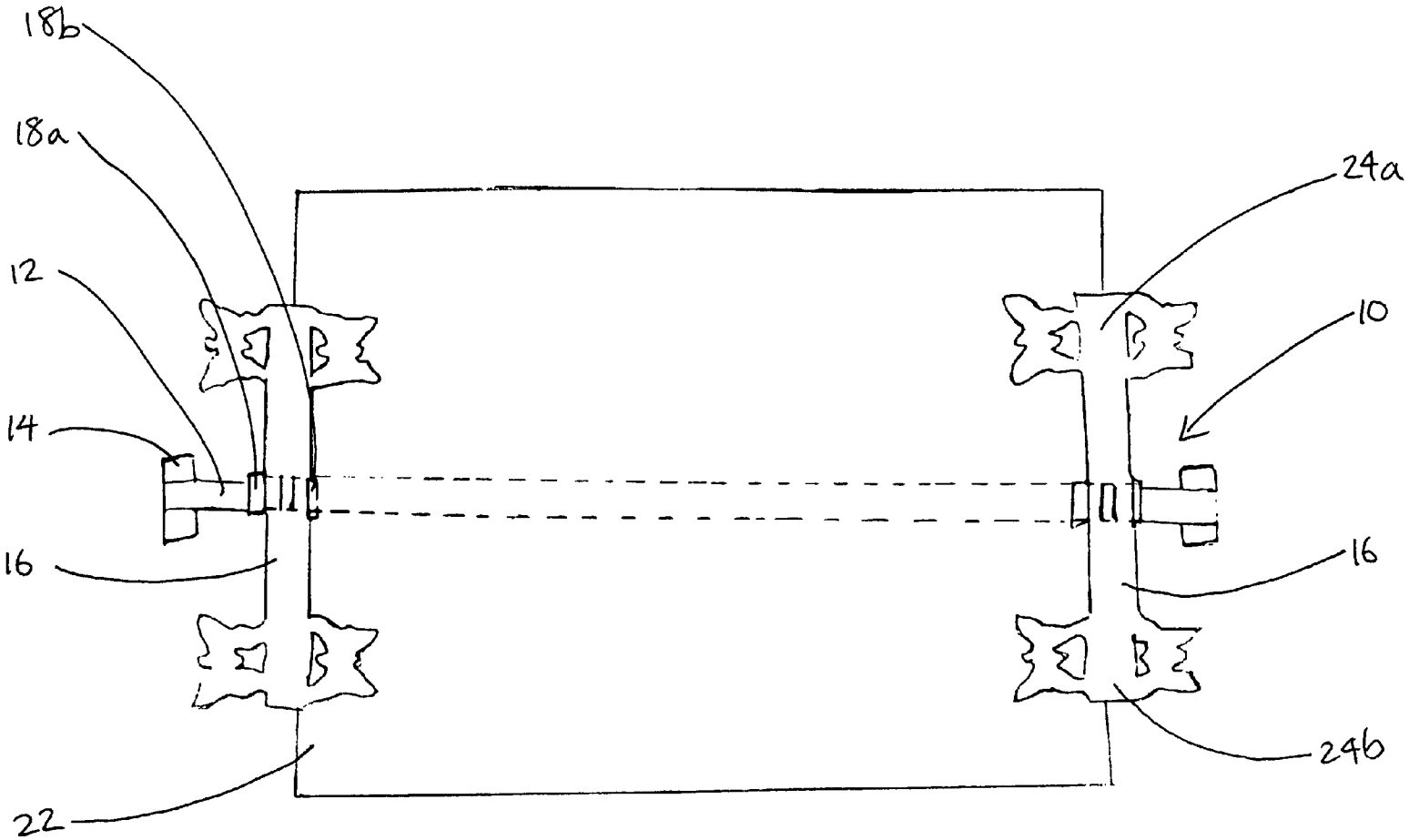
FIG. 5 is a front perspective view of another alternative embodiment of the sheet mounting apparatus.

FIG. 5 shows a front perspective view of another alternative embodiment of the sheet mounting apparatus 10, in which mounting members 16 include member extensions 24*a* and 24*b*, which extend generally perpendicular to the strap 12. The member extensions 24*a* and 24*b* provide an increased surface area gripping mounted sheet 22, and help prevent furling of mounted sheet 22. The member 24*a* and 24*b* may also include decorative elements, in this case, butterflies, that enhance the aesthetics of the mounting member 16. It will be understood that additional designs or the like may be applied to the mounting members 16, straps 12, or fasteners 14.

Figure 6:
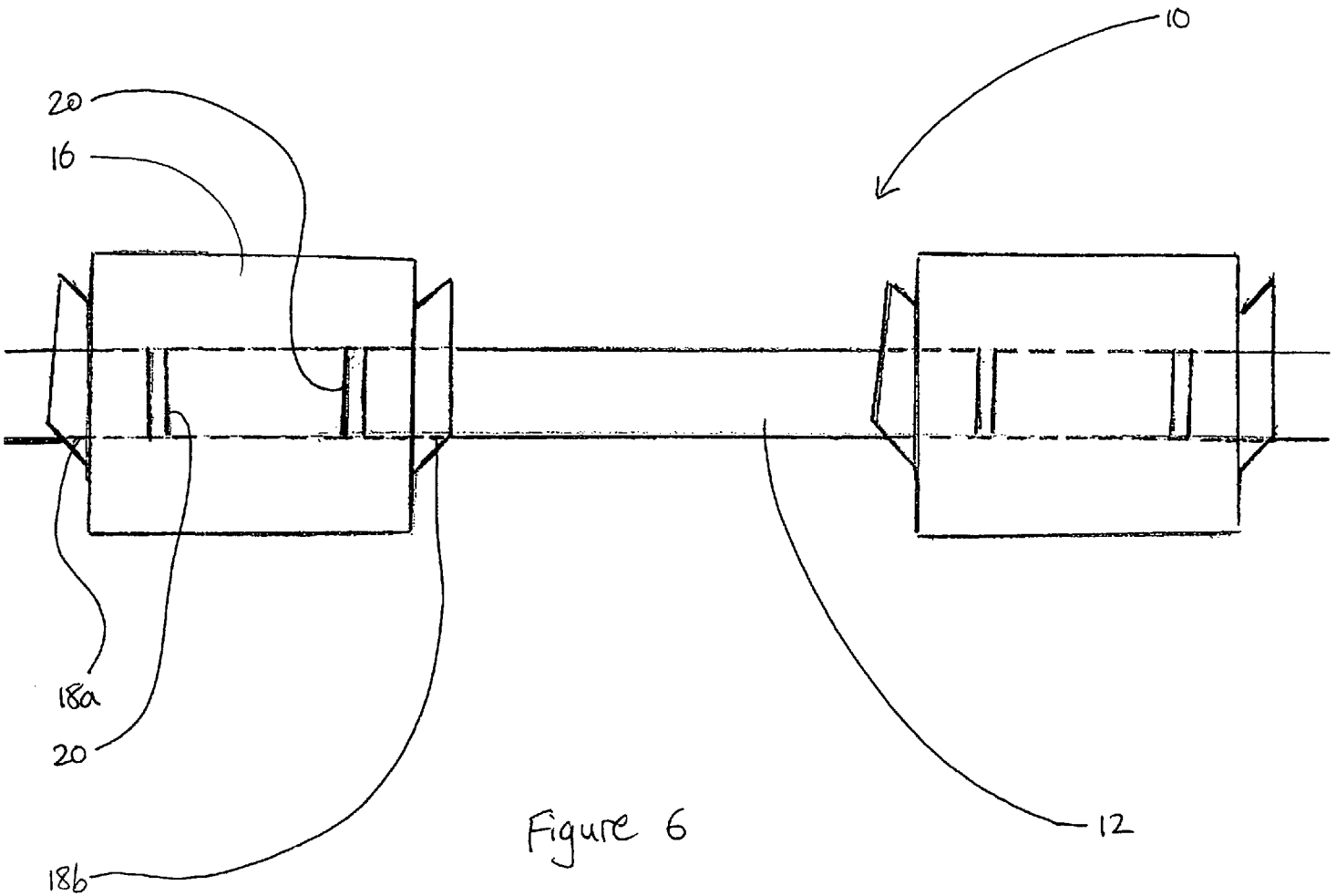
FIG. 6 is a front perspective view of yet another alternative embodiment of the sheet mounting apparatus.

FIG. 6 shows a front perspective view of yet another alternative embodiment of the sheet mounting apparatus 10, in which mounting members 16 include two pairs of slits 20. The placement of a pair of slits 20 near each wing 18*a* and 18*b* ensures that in a wide mounting member 16, there is sufficient pressure between mounting member 16 and strap 12 to mount a sheet. A wide mounting member 16 may provide a border, or frame, for mounted images or documents, and decorative elements or other elements may be incorporated on the mounting member 16 between the two pairs of slits 20. Additionally, the region of the mounting member 16 between the two pairs of slits 20 exerts pressure on strap 12, and can be used to mount sheets.

Figure 7B:
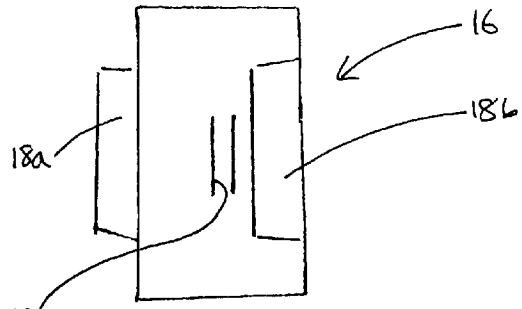
FIGS. 7A to 7F are front perspective view of various embodiments of the mounting members.
Figure 7A:
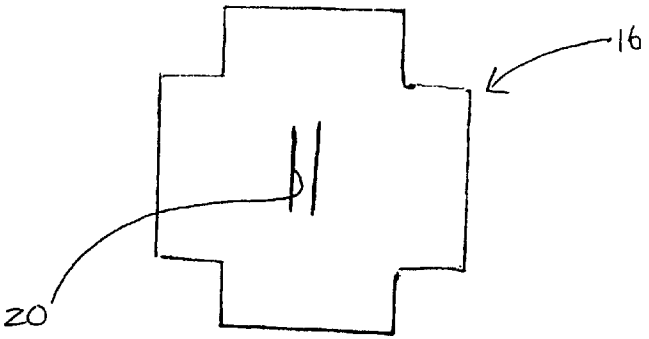
Figure 7D:
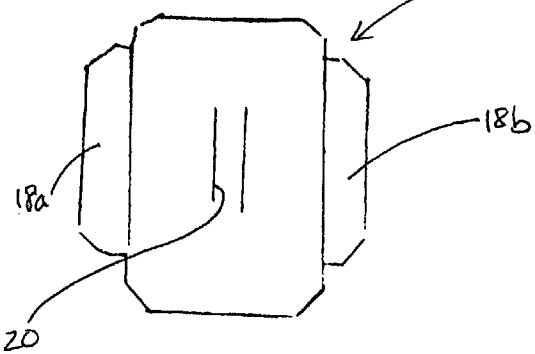
Figure 7C:
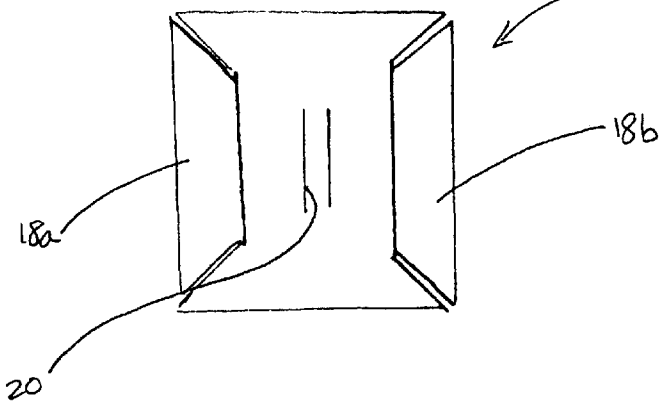
Figure 7F:
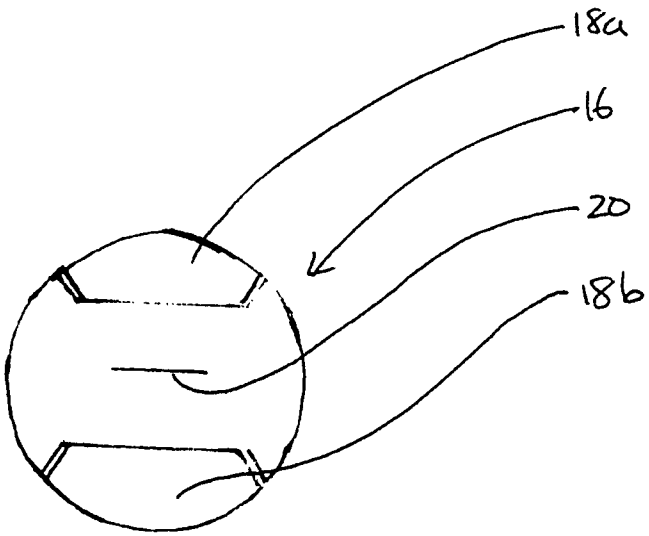
Figure 7E:
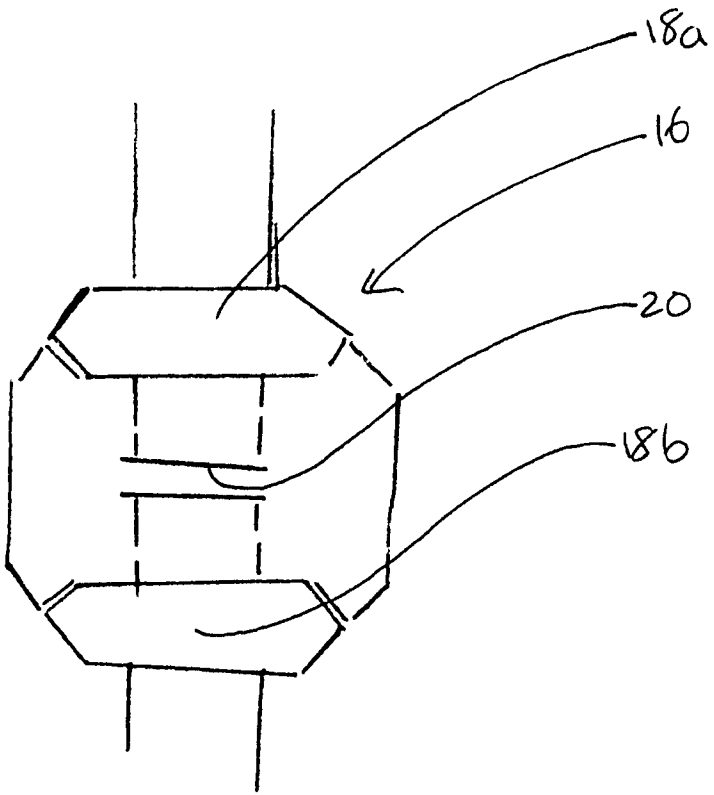

FIGS. 7A to 7F show front perspective views of several varieties of mounting members 16. FIG. 7A shows a mounting member 16 which is cross-shaped. FIG. 7B shows a mounting member 16 that includes rectangular wings 18*a* and 18*b*. FIG. 7C shows a mounting member 16 includes wings 18*a* and 18*b* in the shape of trapezoids. FIG. 7D shows a mounting member 16 similar to the one shown in FIG. 7B, but with truncated corners. Likewise, FIG. 7E shows a mounting member 16 similar to the one shown in FIG. 7C, but with truncated corners. FIG. 7F shows a mounting member 16 which flattens into the shape of disc and includes wings 18*a* and 18*b* with a shape defined by slits extending into the flattened disc. The wings 18*a* and 18*b* in the above-described mounting members facilitate lifting of mounting member 16, and sliding of mounting member 16 along track 12. The wings 18*a* and 18*b* can be rigid or flexible, and can protrude from the main plane of the mounting member 16 and away from strap 12. Mounting member 16 can also be creased such that wings 18*a* and 18*b* can easily bend away from the strap 12. In the case of flexible wings, the wings may be designed to lie flat such that a sheet may be placed flat over top of a mounting member 16. Additionally, the surface of mounting member 16 that contacts sheet 22 can be adapted to provide additional grip. For example, the surface can be textured, or be formed of a material with a high friction coefficient such as rubber.

The above-described embodiments are intended to be examples only. Alterations, modifications and variations can be effected to the particular embodiments by those of skill in the art without departing from the scope of the invention, which is defined solely by the claims appended hereto.

What I claim is:

1. A sheet supporting apparatus comprising:

a strap;

at least two mounting members, each mounting member slidably mounted on the strap, each mounting member comprising at least two opposed flexible wings;

wherein each wing is provided in a first position and urged to return to the first position when lifted relative to the strap from the first position to a second position; and, wherein the wings protrude upwardly from the strap when in the first position.

2. The apparatus according to claim 1, wherein the wings protrude upwardly from the strap and from the first position when in the second position.

3. The apparatus according to claim 1, wherein each mounting member comprises a pair of parallel slits and wherein the mounting member is slidably mounted to the strap by passage of the strap through the slits.

4. The apparatus according to claim 1, wherein the apparatus is configured to support a sheet by pressure between two of the at least two mounting members and the strap.

5. The apparatus according to claim 1, wherein the mounting member has two opposed sides to which the two wings are mounted and wherein lifting of the wings relative to the strap causes the sides to protrude relative to the strap.

6. The apparatus according to claim 5, wherein the apparatus is configured to support a sheet between each side of the mounting member and the strap.

7. The apparatus according to claim 1, wherein a surface of the mounting member is adapted to provide grip through texture and/or coefficient of friction.

8. The apparatus according to claim 1, wherein the mounting members are made from a plastic material.

9. The apparatus according to claim 1, wherein the apparatus is configured to mount the sheet diagonally between the mounting members.

10. A sheet supporting apparatus comprising:

a strap;

at least two mounting members, each mounting member slidably mounted on the strap, each mounting member being flexible; and, wherein at least one of the at least two mounting members comprises at least two wings, the mounting member configured to support a sheet beneath each wing.

11. The apparatus according to claim 10, wherein the apparatus is configured to support a plurality of sheets arrayed along the strap.

12. The apparatus according to claim 11, wherein the number of mounting members is equal to the number of sheets plus one.

13. The apparatus according to claim 12, wherein the apparatus comprises at least three mounting members and is configured to support at least two sheets along the strap, wherein at least one of the at least three mounting members supports two sheets.

14. The apparatus according to claim 10, wherein the mounting member has two opposed sides to which the two wings are mounted and wherein lifting of the wings relative to the strap causes the sides to protrude relative to the strap.

15. The apparatus according to claim 14, wherein the apparatus is configured to support a sheet between each side of the mounting member and the strap.

16. The apparatus according to claim 10, wherein each mounting member comprises a pair of parallel slits and wherein the mounting member is slidably mounted to the strap by passage of the strap through the slits.

17. A sheet supporting apparatus configured to mount a sheet on a supporting surface, comprising:

a strap;

at least two mounting members, each mounting member slidably mounted on the strap, each mounting member being flexible;

wherein the strap comprises adhesive structure configured to adhesively mount the apparatus to the supporting surface;

wherein the strap has two sides and wherein the adhesive structure is provided on a side of the strap proximal the supporting surface;

wherein each mounting member comprises at least two opposed flexible wings;

wherein the mounting member is configured to support a sheet beneath each wing;

wherein the apparatus is configured to support a sheet by pressure between two of the at least two mounting members and the strap;

wherein the mounting member has two opposed sides to which the two wings are mounted and wherein lifting of the wings relative to the strap causes the sides to protrude relative to the strap;

wherein each wing is provided in a first position and urged to return to the first position when lifted relative to the strap from the first position to a second position;

wherein the wings protrude upwardly from the strap when in the first position and upwardly from the strap and from the first position when in the second position;

wherein each mounting member comprises a pair of parallel slits and wherein the mounting member is slidably mounted to the strap by passage of the strap through the slits; and, wherein the mounting members are made from a plastic material.

* * * * *